US006073923A

United States Patent [19]

Lin et al.

[11] Patent Number: 6,073,923

[45] Date of Patent: Jun. 13, 2000

[54] PAPER-FEEDING MECHANISM FOR A DOCUMENT DUPLICATING MACHINE

[75] Inventors: Chin-I Lin, Tao Yuan; Jung-Ting Hsia, Hsinchu; Tsang-Huai Chang, ChangHua, all of Taiwan

[73] Assignee: UMAX Data Systems

[21] Appl. No.: 09/048,957

[22] Filed: Mar. 26, 1998

[51] Int. Cl.[7] ..... B65H 5/00

[52] U.S. Cl. ..... 271/10.03; 271/10.04; 271/10.11; 271/114; 271/127

[58] Field of Search ..... 271/10.03, 10.04, 271/10.11, 10.13, 126, 127, 114, 118

[56] References Cited

U.S. PATENT DOCUMENTS 5,213,426 5/1993 Ewling ..... 271/126
5,228,676 7/1993 Arai et al. ..... 271/117
5,725,208 3/1998 Miyauchi ..... 271/127
5,782,468 7/1998 Wu et al. ..... 271/10.11
5,791,646 8/1998 Lyo et al. ..... 271/10.11

*Primary Examiner*—H. Grant Skaggs
*Attorney, Agent, or Firm*—W. Wayne Liauh

[57] ABSTRACT

A paper-feeding mechanism for a document duplicating machine, which is driven by a single power source and performs intermittent paper-loading control and continuous paper-conveying operation on a paper loader of the document duplicating machine, comprises a driving device capable of both clockwise and counterclockwise running operation, a paper-loading device for carrying out the intermittent paper sheet retrieval from the paper loader, a paper-conveying device for performing forwarding of the paper sheet retrieved from the paper loader, and a paper-conveying-and-loading control device for separating the paper-conveying and paper-loading operation of the paper-feeding mechanism.

8 Claims, 3 Drawing Sheets

PAPER-FEEDING MECHANISM FOR A DOCUMENT DUPLICATING MACHINE

BACKGROUND OF THE INVENTION (1) Field of the Invention

The invention relates to a paper-feeding mechanism for a document duplicating machine, and more particularly to which is driven by a single power source and performs intermittent paper-loading control and continuous paper-conveying operation on a paper loader of the document duplicating machine; such as copy machine, printer, facsimile machine, scanner, imager, and any as the like.

(2) Description of the Prior Art

Conventionally, continuous paper-conveying and intermittent paper-loading of either origin or blank paper on a document duplicating machine is carried out by controlling one or a plurality of paper loaders. The document duplicating machine can be a copy machine, a printer, a facsimile machine, a scanner, an imager, and any as the like.

It is well known in the art that two mechanisms are usually facilitated to perform such paper-conveying and paper-loading control; they are a clutching mechanism (ex. U.S. Pat. No. 5,213,426) and a double-motor mechanism. In general application, the paper loader to go with the double-motor mechanism usually has a spring device to provide secure contact between the top paper in the paper loader and a paper-loading roller. However, the spring device is seldom seen in a duplicating machine with a clutching mechanism.

In a clutching mechanism, controls for paper-conveying and paper-loading are separated by a clutch. Though a single motor is used in the clutching mechanism, yet the cost is higher for its complicate control clutching elements and synthesis.

On the other hand, the double-motor mechanism applies two independent motors to perform paper-conveying and paper-loading separately. Although, the application of motors and control are simple, yet the dynamics characteristics of the double-motor mechanism is complicated and much unpredictable. Apparently, the two vibration sources, i.e. these two motors, will contribute a lot to dynamics uncertainty in the document duplicating machine.

Therefore, an invention devoting to resolving aforesaid disadvantages of conventional paper-feeding mechanism for a document duplicating machine is necessary, definitely.

SUMMARY OF THE INVENTION

Accordingly, it is a primary object of the present invention to provide a paper-feeding mechanism for a document duplicating machine, which is controlled by a single power source in executing paper-loading from a paper loader and following paper-conveying operation of a document duplicating machine.

It is another object of the present invention to provide a paper-feeding mechanism for a document duplicating machine, which utilizes optional meshing between a planet gear set and a complex gear set to distinguish the paper-loading-and-conveying operation from the paper-conveying operation.

It is still another object of the present invention to provide a paper-feeding mechanism for a document duplicating machine, which applies a paper-pressing cam onto the base plate of the paper loader to perform paper-loading at accurate timing.

The invention relates to a paper-feeding mechanism for a document duplicating machine, which uses a single power source to perform controls on intermittent paper-loading and continuous paper-conveying operation. The document duplicating machine can be a copy machine, a printer, a facsimile machine, a scanner, an imager, or any as the like.

According to the invention, the paper-feeding mechanism is located preferably adjacent to the paper loader in a document duplicating machine. In the paper loader, paper for loading is placed on top of a compressible base plate located on the bottom of the paper loader. The paper-feeding mechanism comprises a driving means, a paper-loading means, a paper-conveying means, and a conveying-and-loading control means.

The driving means is used as the power source for the paper-feeding mechanism, and preferably can be a DC motor which is capable of both clockwise and counterclockwise operation. While the DC motor running clockwise, the paper-feeding mechanism is at the status of paper-conveying. While the DC motor running counterclockwise, the paper-feeding mechanism is at the status of paper-loading-and-conveying, i.e. both paper-loading and paper-conveying at work.

The paper-loading means is applied to carry out the intermittent paper sheet retrieval from the paper loader, and preferably comprises a paper-pressing cam, a paper-loading gear, and a paper-loading roller. Wherein, the paper-loading cam is located right above the paper loader, with its profile contour touching upon the base plate. The profile of the cam is designed to control the up-and-down motion of the base plate. The paper-loading gear is located at a proper position above one side of the paper loader, to facilitate paper-loading operation. The paper-loading roller is co-axial and co-rotating with the paper-loading gear. While the paper-pressing cam controls the base plate upwards, the lower edge of the paper-loading roller touches top paper sheet in the paper loader, and retrieves the top paper sheet by rolling.

The paper-conveying means is applied to carry out the forwarding of the paper sheet retrieved from the paper loader, and preferably comprises a paper-conveying gear, a paper-conveying roller, and further a paper-conveying idle wheel. The paper-conveying gear is used to keep the paper-conveying operation at unique direction, no matter what direction the DC motor is running. The paper-conveying roller is co-axial and co-rotating with the paper-conveying gear, and utilizes its lower roller surface to drive the paper forward. The paper-conveying idle wheel is meshed with the paper-conveying gear, in order to maintain the paper-conveying gear rotating at the unique direction while the driving means rotates clockwise.

The conveying-and-loading control means is used to separate the paper-conveying and paper-loading operation. While the driving means runs clockwise to proceed the paper-conveying operation, the conveying-and-loading control means drives the paper-loading idle wheel and the paper-pressing cam respectively, to have the paper-conveying means performing paper-conveying and to have the paper-pressing cam driving the base plate downwards for terminating the contact between the paper in the paper loader and the paper-loading roller. While the driving means runs counterclockwise to proceed the paper-conveying-and-loading operation, the conveying-and-loading control means drives the paper-conveying gear, the paper-pressing cam, and the paper-loading gear, respectively; to have the paper-conveying operation proceed at the unique direction, to have the paper-pressing cam driving the base plate upwards for having the top paper sheet in the paper loader and the paper-loading roller into contact, and to have the paper-loading gear performing the paper-loading operation. Preferably, the conveying-and-loading control means comprises a planet gear set and a paper-loading control unit.

According to the present invention, the planet gear set is driven by the driving means, for performing continuously the paper-conveying operation of the paper-conveying means and for performing intermittently the paper-loading operation of the paper-loading means. Preferably, the planet gear set further comprises a sun gear driven directly by the driving means, and three planet gears meshed with the sun gear. These three planet gears can be a first planet gear, a second planet gear, and a third planet gear.

The paper-loading control unit, driven by the third planet gear of the planet gear set, is used to drive the paper-pressing cam pressing the base plate downwards for disconnecting the paper in the paper loader and the paper-loading roller, while the driving means runs clockwise for paper-conveying operation. While the driving means runs counterclockwise for paper-conveying-and-loading operation, the paper-loading control unit drives the paper-pressing cam to have the base plate upwards for contacting of the top paper sheet in the paper loader and the paper-loading roller, and drives the paper-loading gear as well as the paper-loading roller for executing the paper-loading operation.

Preferably, the paper-loading control unit can be a complex gear set, and further comprises a complex gear with three layers of co-axial and co-rotating gears, and two idle gears to mesh alternatively with the third planet gear of the planet gear set.

According to the present invention, to assure the driving means carrying out correct timing of reversing the running direction, the paper-feeding mechanism further comprises a paper-conveying sensor at the paper-conveying means, for monitoring the paper-conveying operation and determining the accurate timing to reverse the driving means.

In case that space available between the paper loader and the paper-conveying roller is limited, another embodiment according to the present invention can utilize the paper-conveying means and the paper-pressing cam to carry out the aforesaid operation achieved by the paper-loading means and the paper-conveying means.

All these objects are achieved by the paper-feeding mechanism for a document duplicating machine described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a paper-feeding mechanism for a document duplicating machine. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

The paper-feeding mechanism for a document duplicating machine according to the invention, which uses a single power source motor to perform controls on intermittent paper-loading and continuous uni-direction paper-conveying operation, is applied to the document duplicating machine such as a copy machine, a printer, a facsimile machine, a scanner, an imager, or any as the like.

Figure 1:
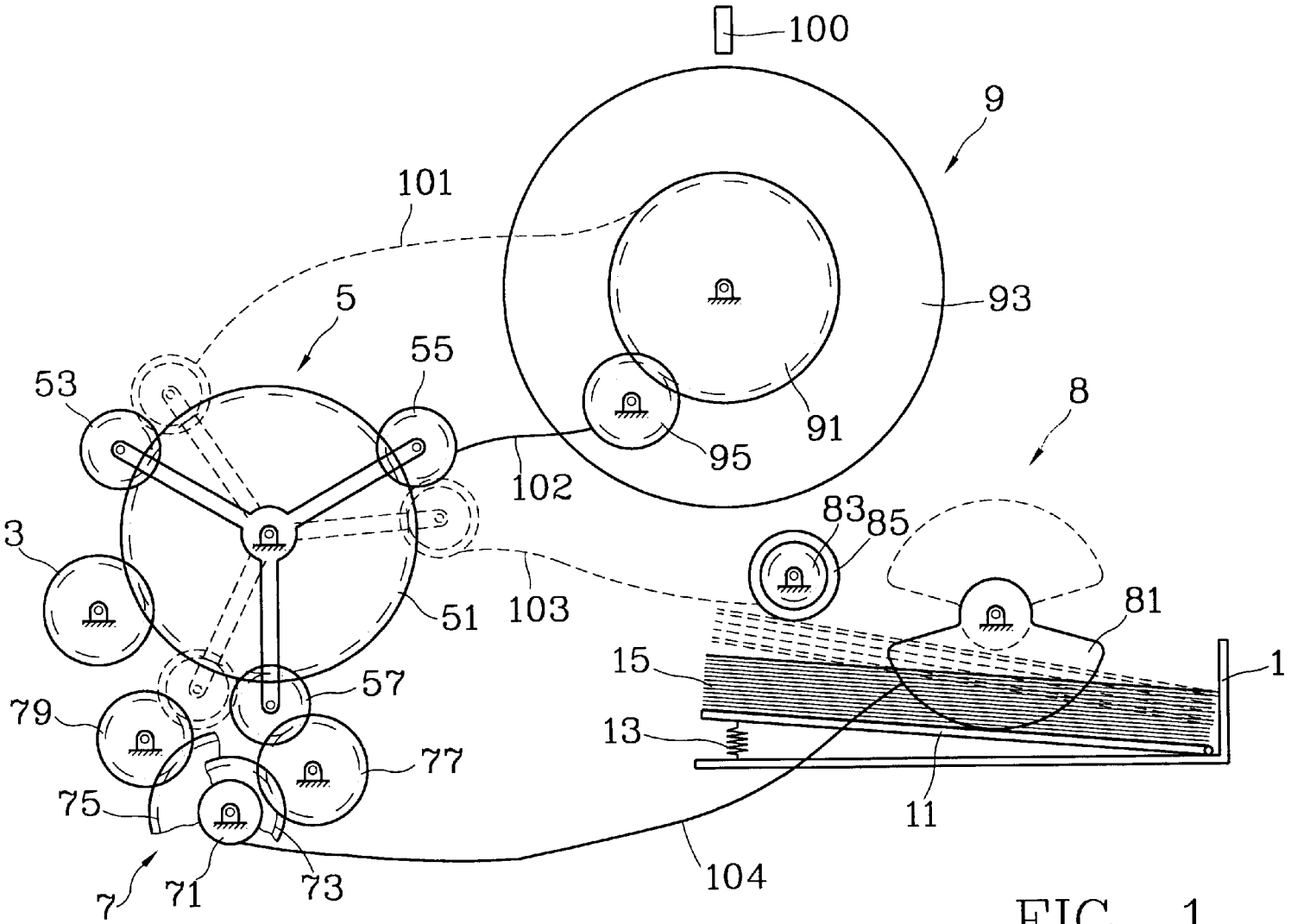
FIG. 1 is a schematic view of the preferred paper-feeding mechanism for a document duplicating machine in accordance with the present invention.

Please refer to FIG. 1 for a schematic view of the preferred paper-feeding mechanism for a document duplicating machine in accordance with the present invention. The paper-feeding mechanism is located preferably adjacent to the paper loader 1, or at any available space, in the document duplicating machine. In the paper loader 1, paper 15 for loading is placed on top of a compressible base plate 11 which is located on the bottom of the paper loader 1, with one side thereof pivotedly connected to the paper loader 1 and having a compression spring 13 located under the other side of the base plate 11 to make the base plate 11 compressible at the spring side.

Preferably, the paper-feeding mechanism comprises a driving means 3, a paper-loading means 8, a paper-conveying means 9, and a conveying-and-loading control means.

According to the present invention, the driving means 3 is used as the power source for the paper-feeding mechanism, and preferably can be a DC motor which is capable of both clockwise and counterclockwise operation. While the DC motor running clockwise, the paper-feeding mechanism is it the paper-conveying status. On the other hand, while the DC motor running counterclockwise, the paper-feeding mechanism is at the status of paper-loading-and-conveying, i.e. a dual-mode operation with paper-loading and continuing paper-conveying simultaneously.

The paper-loading means 8 is applied to carry out the intermittent paper 15 retrieval from the paper loader 1, and preferably comprises a paper-pressing cam 81, a paper-loading gear 83, and a paper-loading roller 85. Wherein, the paper-loading cam (previously described as paper-pressing cam) 81 is located right above the paper loader 8, with its profile contour touching upon the base plate 11; preferably, touching along one side edge of the base plate 11 so that the motion of the paper-pressing cam 81 does not interfere with the paper 15. The profile of the paper-pressing cam 81 is designed to control the up-and-down motion of the base plate 11. By providing the compression spring 13, the contact between the base plate 11 and the paper-pressing cam 81 is further ensured.

The paper-loading gear 83 is located at a proper position above one side of the paper loader 1 to facilitate paper-loading operation. Preferably, the location of the paper-loading gear 83 is above the paper loader 1 at the side where the compression spring 13 locates. The paper-loading roller 85 is co-axial and co-rotating with the paper-loading gear 83. While the paper-pressing cam 81 controls the base plate 11 as well as the paper 15 on top of the base plate 11 upwards, the lower edge of the paper-loading roller 85 touches top paper 15 sheet in the paper loader 11, and retrieves the top paper 15 sheet by rolling. Preferably, the paper-loading roller 85 is a plastic roller.

According to the present invention, the paper-conveying means 9 is applied to forward the paper 15 sheet retrieved from the paper loader 1, and preferably comprises a paper-conveying gear 91, a paper-conveying roller 93, and a paper-conveying idle wheel 95. The paper-conveying gear 91 is used to keep the paper-conveying operation at unique direction, no matter what direction the DC motor of the driving means 3 is operating. The paper-conveying roller 93 is co-axial and co-rotating with the paper-conveying gear 91, and utilizes its lower roller surface to drive the paper 15 forward by friction. The paper-conveying idle wheel 95 is meshed with the paper-conveying gear 91, in order to maintain the paper-conveying gear 91 rotating at the unique direction while the driving means rotates clockwise.

The uni-direction operation of the paper-conveying gear 91 is achieved by directly driven via the conveying-and-loading control means while the driving means 3 running counterclockwise, and indirectly driven via the conveying-and-loading control means through the paper-conveying idle wheel 95 while the driving means 3 running clockwise.

The conveying-and-loading control means is used to separate the paper-conveying and paper-loading operation. While the driving means 3 runs clockwise to proceed the paper-conveying operation, the conveying-and-loading control means drives the paper-loading idle wheel 95 and the paper-pressing cam 81, respectively, to have the paper-conveying means 9 performing paper-conveying and to have the paper-pressing cam 81 driving the base plate 11 downwards for terminating the contact between the paper 15 in the paper loader 1 and the paper-loading roller 85. While the driving means 3 runs counterclockwise to proceed the paper-conveying-and-loading operation, the conveying-and-loading control means drives the paper-conveying gear 91, the paper-pressing cam 81, and the paper-loading gear 83, respectively; to have the paper-conveying operation proceed at the unique direction, to have the paper-pressing cam 83 driving the base plate 11 upwards for having the top paper 15 sheet in the paper loader 1 and the paper-loading roller 85 into contact, and to have the paper-loading gear 83 performing the paper-loading operation. Preferably as the embodiment shown in FIG. 1, the conveying-and-loading control means further comprises a planet gear set 5 and a paper-loading control unit 7.

According to the present invention, the planet gear set 5 is driven by the driving means 3, for performing continuously the paper-conveying operation of the paper-conveying means 9 and for performing intermittently the paper-loading operation of the paper-loading means 8. Preferably, the planet gear set 5 further comprises a sun gear 51 driven directly by the driving means 3, and three planet gears meshed with the sun gear 51. These three planet gears can be a first planet gear 53, a second planet gear 55, and a third planet gear 57.

The first planet gear 53 meshes always with the sun gear 51, but meshes intermittently with the paper-conveying gear 91 of the paper-conveying means 9. While the driving means 3 runs clockwise, the first planet gear 53 disengages with the paper-conveying gear 91. On the other hand, While the driving means 3 runs counterclockwise, the first planet gear 53 engages with the paper-conveying gear 91 via a first transmitting means 101.

The second planet gear 55 meshes always with the sun gear 51, but meshes alternatively with paper-loading gear 83 and paper-conveying idle wheel 95. While the driving means 3 runs clockwise, the second planet gear 55 engages with the paper-conveying idle wheel 95 via a second transmitting means 102. On the other hand, While the driving means 3 runs counterclockwise, the second planet gear 55 engages with the paper-loading gear 83 via a third transmitting means 103.

The third planet gear 57 meshes with the sun gear 51 and is used to drive the paper-loading control unit 7.

In the aforesaid description, the first transmitting means 101, the second transmitting means 102, and the third transmitting means 103 can be any possible transmission mechanism between two gears, which does not alter the relative meshing operation between these two gears connecting at both terminals of the transmission mechanism. The major purpose of these three transmitting means 101, 102, and 103 is to resolve possible space limitation existed between two designed meshing gears. Preferably, each of these three transmitting means 101, 102, and 103 can be nothing (i.e. directly connection between two designed meshing gears), a transmission gear set with even number of gears, or any as the like.

The paper-loading control unit 7, driven by the third planet gear 57 of the planet gear set 5, is used to drive the paper-pressing cam 81 pressing the base plate 11 downwards for disconnecting the paper 15 in the paper loader 15 and the paper-loading roller 85, while the driving means 3 runs (clockwise for paper-conveying operation. While the driving means 3 runs (counterclockwise for paper-conveying-and-loading operation, the paper-loading control unit 7 drives the paper-pressing cam 81 to have the base plate 11 upwards for contacting of the top paper 15 sheet in the paper loader 1 and the paper-loading roller 85, and drives the paper-loading gear 83 as well as the paper-loading roller 85 for executing the paper-loading operation.

Preferably, as illustrated in FIG. 1, the paper-loading control unit 7 can be a complex gear set, and further comprises a complex gear with three layers of co-axial and co-rotating gears, and two idle gears to mesh alternatively with the third planet gear 57 of the planet gear set 5.

The first layer of the complex gear is called the output gear 71; which is used to drive the paper-pressing cam 81 via a fourth transmitting means 104 for lowering the base plate 11 during the driving means 3 running clockwise, and used to drive the paper-pressing cam 81 via the fourth transmitting means 104 for elevating the base plate 11 during the driving means 3 running counterclockwise.

The fourth transmitting means 104 can be any possible transmission mechanism between the output gear 71 and the paper-pressing cam 81, which does not alter the relative meshing operation there between. Similar to aforesaid three transmitting means 101, 102, and 103, the major purposes of the fourth transmitting means 104 is to resolve possible space limitation existed in conjunction between the output gear 71 and the paper-pressing cam 81. Preferably, the fourth transmitting means 104 can be nothing, a transmission gear set, or any as the like.

The second layer of the complex gear is called the first portion gear 73, which is preferable a gear with teeth surrounding only in a portion of its circumference. While the driving means 3 runs clockwise, the first portion gear 73 meshes with the third planet gear 57 of the planet gear set 5 via a first idle gear 77. While the driving means 3 runs counterclockwise, the first portion gear 73 meshes with the first idle gear 77 only.

The third layer of the complex gear is called the second portion gear 75, which is also preferable a gear with teeth surrounding only in a portion of its circumference. While the driving means 3 runs counterclockwise, the second portion gear 75 meshes with the third planet gear 57 of the planet gear set 5 via a second idle gear 79. While the driving means 3 runs clockwise, the second portion gear 75 meshes with the second idle gear 79 only.

According to the present invention, to assure the driving means 3 carrying out correct timing of reversing the running direction, the paper-feeding mechanism further comprises a paper-conveying sensor 100 at the paper-conveying means 9, for monitoring the paper-conveying operation and determining the accurate timing to reverse the driving means 3.

Figure 2:
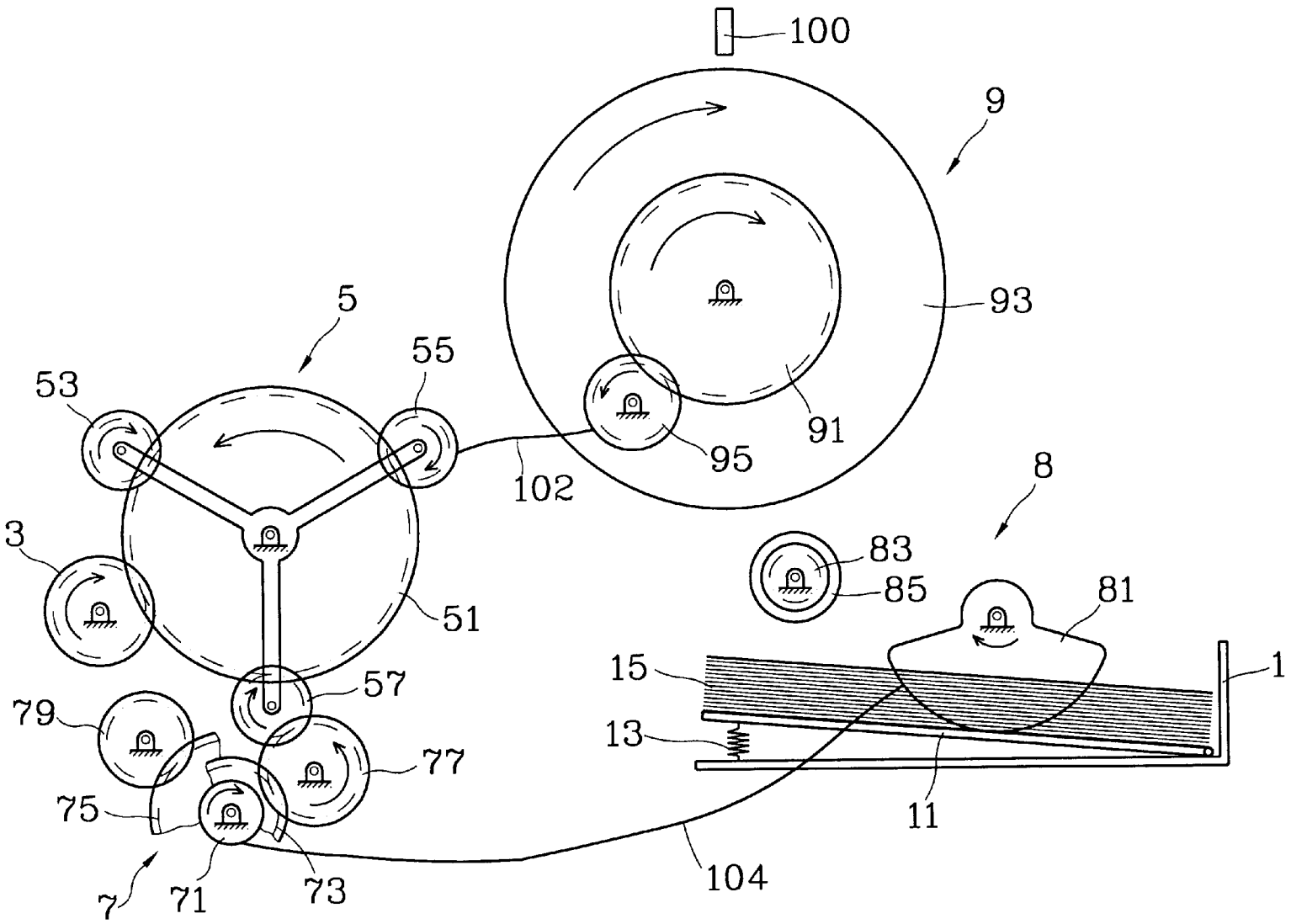
FIG. 2 is a schematic view of the preferred paper-feeding mechanism for a document duplicating machine in FIG. 1 at its paper-conveying operation.

Referring now to FIG. 2, it shows a schematic view of the preferred paper-feeding mechanism for a document duplicating machine at its paper-conveying operation. While the paper-feeding mechanism is at paper-conveying operation, the driving means 3 runs clockwise, the sun gear 51 of the planet gear set 5 runs counterclockwise, three planet gears (53, 55, and 57) runs clockwise and with their centers moving clockwise along the circumference of the sun gear 51. Wherein the first planet gear 53 and the paper-conveying gear 91 is disengaged. The second planet gear 55 engages with the paper-conveying idle wheel 95 via the second transmitting means 102, and disengages with the paper-loading gear 83. Because the second transmitting means 102 does not alter the meshing situation and the second planet gear 55 runs clockwise, the paper-conveying idle wheel 95 runs counterclockwise, thus the paper-conveying gear 93 carries the paper-conveying at clockwise direction.

While the paper-feeding mechanism is at paper-conveying operation, the third planet gear 57 engages with the first idle gear 77 running counterclockwise. Thereby, the first portion gear 73 meshing with the first idle gear 77 runs clockwise and drives the output gear 71 running clockwise. The paper-pressing cam 81, driven by the output gear 71 via the four transmitting means 104, then rotates to drive the base plate 15 of the paper loader 1 downwards to terminate the contact of the paper 15 in the paper loader 1 and the paper-loading roller 85; i.e. suspending the paper-loading operation.

Figure 3:
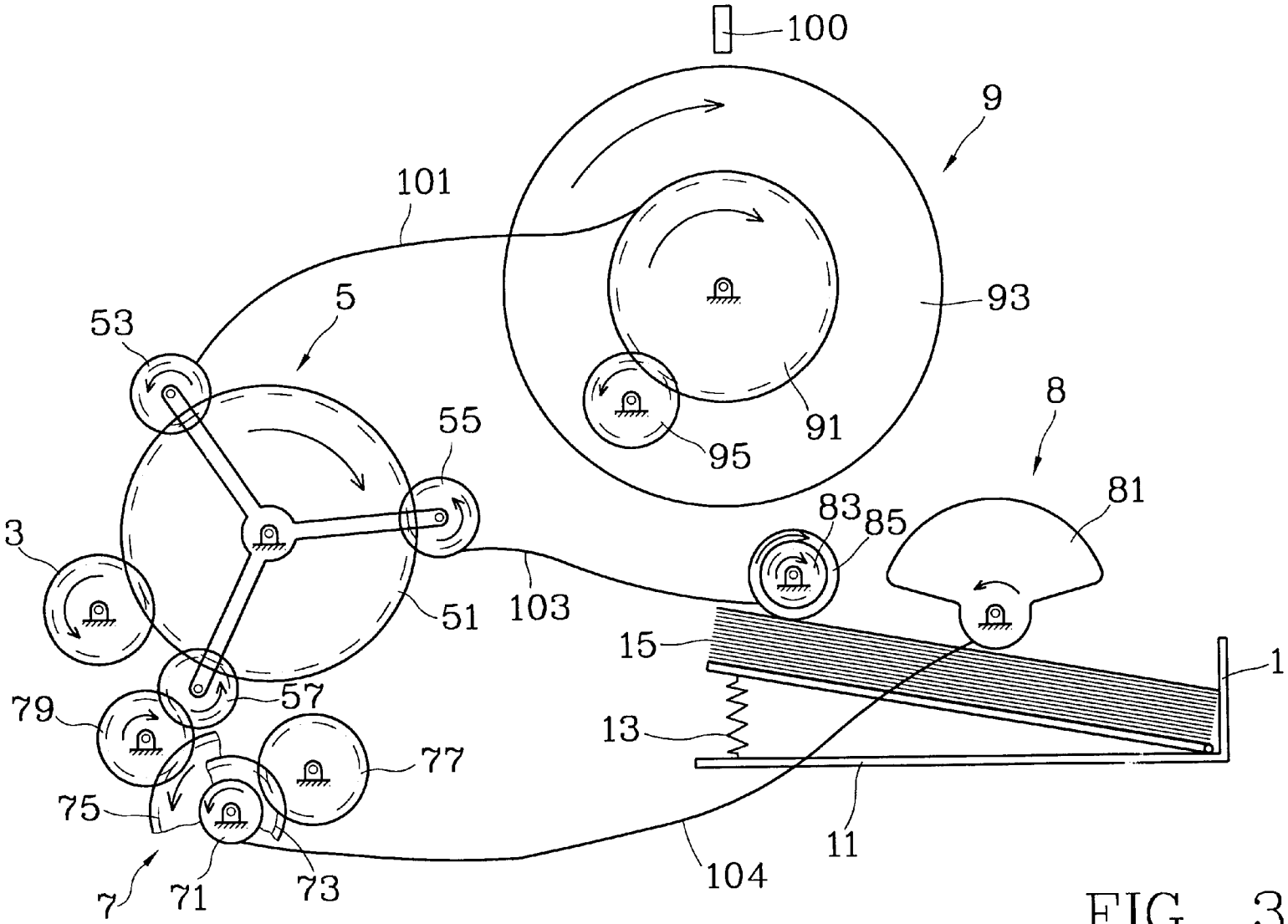
FIG. 3 is a schematic view of the preferred paper-feeding mechanism for a document duplicating machine in FIG. 1 at its paper-conveying-and-loading operation.

Referring now to FIG. 3, it shows a schematic view of the preferred paper-feeding mechanism for a document duplicating machine at its paper-conveying-and-loading operation. While the paper-feeding mechanism is at this stage of operation, the driving means 3 runs counterclockwise, the sun gear 51 of the planet gear set 5 runs clockwise, three planet gears (53, 55, and 57) runs counterclockwise and with their centers moving counterclockwise along the circumference of the sun gear 51. Wherein the first planet gear 53 engages with the paper-conveying gear 91 running clockwise, via the first transmitting means 101. The paper-conveying gear 91 and the paper-conveying roller 93 rotate synchronically, and to have the paper 15 conveyed continuously at the same clockwise direction. The second planet gear 55 disengages with the paper-conveying idle wheel 95, but engages with the paper-loading gear 83 via the third transmitting means 103 to have the paper-loading roller 85 running clockwise.

While the paper-feeding mechanism is at paper-loading operation, the third planet gear 57 engages with the second idle gear 79 running clockwise, and disengages with the first idle gear 77. Thereby, the second portion gear 75 meshing with the second idle gear 79 runs counterclockwise and drives the output gear 71 running counterclockwise. The paper-pressing cam 81, driven by the output gear 71 via the four transmitting means 104, then rotates to have the base plate 15 of the paper loader 1 upwards to achieve the contact of the top paper 15 sheet in the paper loader 1 and the paper-loading roller 85; i.e. proceeding the paper-loading operation.

In the aforesaid description of the preferred embodiment of the paper-feeding mechanism according to the present invention, the paper-loading means 8 and the paper-conveying means 9 are two independent unit, and is suitable to the document duplicating machine which has enough space available between the paper loader 1 and the paper-conveying roller 93. In case that there is only limited space available between the paper loader 1 and the paper-conveying roller 1, another embodiment according to the present invention can utilize the paper-conveying means 8 and the paper-pressing cam 83 to replace the aforesaid operation achieved by aforesaid the paper-loading means 8 and the paper-conveying means 9. Wherein, the paper-conveying gear 91 and the paper-conveying roller 93 of the paper-conveying means 9 is shifted to replace the paper-loading gear 83 and paper-loading roller 85, respectively. In this embodiment, the third transmitting means 103, the paper-loading gear 83, and the paper-loading roller 85 described in the preferred embodiment are canceled, but all other parts and connecting relation are remained as those in the preferred embodiment of the paper-feeding mechanism for a document duplicating machine.

While the present invention has been particularly shown and described with reference to a preferred embodiment, it will be understood by those skilled in the art that various changes in form and detail may be without departing from the spirit and scope of the present invention.

What is claimed is:

1. A paper-feeding mechanism for a document duplicating machine, said paper-feeding mechanism being driven by a single power source and performs intermittent paper-loading control and continuous paper-conveying operations on a paper loader of the document duplicating machine, and comprising:

a driving means, which is a motor capable of both clockwise and counterclockwise running operations, such that the paper-feeding mechanism is at a paper-conveying status when the motor is running clockwise, and a paper-loading and paper-conveying status when the motor is running counterclockwise;

a paper-loading means, to carry out an intermittent paper sheet retrieval from the paper loader, said paper-loading means comprising:

a paper-pressing cam, located above the paper loader, said paper-loading cam having a profile contour touching a base plate to control an up-and-down motion of the base plate;

a paper-loading gear, located at a position above one side of the paper loader to cause a drive paper-loading operation;

a paper-loading roller, co-axial and co-rotating with the paper-loading gear said paper-loading roller having a lower edge touching the top of a paper sheet in the paper loader when the paper-pressing cam causes the base plate to move upwards; and a paper-conveying means, to cause the paper sheet retrieved from the paper loader to move forward, said paper-conveying means comprising:

a paper-conveying gear, to keep the paper-conveying operation at a constant direction regardless the running direction of the driving means;

a paper-conveying roller, which is co-axial and co-rotating with the paper-conveying gear, having a lower roller surface to drive the paper forward;

a paper-conveying idle wheel, which is meshed with the paper-conveying gear to maintain the paper-conveying gear rotating at the constant direction; and a paper-conveying-and-loading control means to separate the paper-conveying and paper-loading operations of the paper-feeding mechanism such that when the paper-feeding mechanism is in paper-conveying operation, the paper-conveying-and-loading control means driving the paper-loading idle wheel and the paper-pressing cam, respectively, to have the paper-conveying means performing paper-conveying and to have the paper-pressing cam driving the base plate downwards for terminating the contact between the paper in the paper loader and the paper-loading roller, and when the paper-feeding mechanism is in paper-conveying-and-loading operation, the paper-conveying-and-loading control means driving the paper-conveying gear, the paper-pressing cam, and the paper-loading gear, respectively, to cause the paper-conveying operation to proceed at a constant direction, a spring driving the base plate upwards for having the top paper sheet in the paper loader and the paper-loading roller into contact, and the paper-loading gear performing the paper-loading operation.

2. The paper-feeding mechanism for a document duplicating machine according to claim 1, wherein said the paper-conveying-and-loading control means comprises:

a planet gear set, driven by said driving means, for performing continuously the paper-conveying operation of said paper-conveying means and for performing intermittently the paper-loading operation of said paper-loading means, further comprising: a sun gear, driven directly by the driving means;

a first planet gear, always meshing with the sun gear, but only intermittently meshing with the paper-conveying gear of the paper-conveying means such that when the driving means is running clockwise, the first planet gear is disengaged from the paper-conveying gear and when the driving means is running counterclockwise, the first planet gear is engaged with the paper-conveying gear via a first transmitting means;

a second planet gear, always meshing with the sun gear, but only alternatively meshing with the paper-loading gear and the paper-conveying idle wheel such that when the driving means is running clockwise, the second planet gear is engaged with the paper-conveying idle wheel via a second transmitting means and when the driving means is running counterclockwise, the second planet gear is engaged with the paper-loading gear via a third transmitting means;

a third planet gear, meshing with the sun gear; and a paper-loading control unit, driven by the third planet gear, such that when the driving means is running clockwise for paper-conveying operation, the paper-loading control unit drives the paper-pressing cam to press the base plate downward for disconnecting the paper in the paper loader and the paper-loading roller and when the driving means is running counterclockwise for paper-conveying-and-loading operation, the paper-loading control unit drives the paper-pressing cam to move the base plate upward for contacting the top paper sheet in the paper loader and the paper-loading roller, and drives the paper-loading gear as well as the paper-loading roller for executing the paper-loading operation.

3. The paper-feeding mechanism for a document duplicating machine according to claim 2, wherein said first transmitting means is a transmission gear set with an even number of gears.

4. The paper-feeding mechanism for a document duplicating machine according to claim 2, wherein said second transmitting means is a transmission gear set with an even number of gears.

5. The paper-feeding mechanism for a document duplicating machine according to claim 2, wherein said third transmitting means is a transmission gear set with an even number of gears.

6. The paper-feeding mechanism for a document duplicating machine according to claim 2, wherein said paper-loading control unit is a complex gear set which comprises a complex gear with three layers of co-axial and co-rotating gears, wherein the first layer of the complex gear is an output gear for driving the paper-pressing cam via a fourth transmitting means to lower the base plate when the driving means is running clockwise, and for driving the paper-pressing cam via the fourth transmitting means to elevate the base plate when the driving means is running counterclockwise.

7. The paper-feeding mechanism for a document duplicating machine according to claim 6, wherein the fourth transmitting means is a transmission gear set.

8. The paper-feeding mechanism for a document duplicating machine according to claim 1, wherein the paper-feeding mechanism further comprises a paper-conveying sensor located at the paper-conveying means for monitoring the paper-conveying operation and determining the accurate timing to reverse the driving means.

* * * * *